United States Patent [19]

Sernagiotto et al.

[11] 4,236,445

[45] Dec. 2, 1980

[54] CONTINUOUS BELT FILTER PRESS

[76] Inventors: Raffaello Sernagiotto, Via Sant 'Anna 9, Casteggio (Pavia); Emilio Sernagiotto, Via Bobbio 36, Voghera (Pavia), both of Italy

[21] Appl. No.: 35,892

[22] Filed: May 3, 1979

[30] Foreign Application Priority Data

May 4, 1978 [IT] Italy ..... 23012 A/78

[51] Int. Cl.[3] ..... B30B 9/24

[52] U.S. Cl. ..... 100/118; 100/152

[58] Field of Search ..... 100/118, 119, 120, 151, 100/152, 153, 154

[56] References Cited

U.S. PATENT DOCUMENTS 2,575,584 11/1951 Cohen ..... 100/118 X 3,971,310 7/1976 Kandos ..... 100/118

FOREIGN PATENT DOCUMENTS 1199269 6/1959 France ..... 100/118

609264 9/1960 Italy ..... 100/118

692483 7/1965 Italy ..... 100/153

*Primary Examiner*—Edward J. McCarthy

[57] ABSTRACT

A pair of continuous belts, at least one which provided with openings for percolation, are arranged in overlapping relationship and controlled to forward move in the same direction. A loading hopper is provided at the initial portion of the lower belt, and means are arranged opposite to said hopper for varying the angle of convergence of the two belts and accordingly varying, as required, the pressure action exerted by said two belts on the product being treated.

7 Claims, 4 Drawing Figures

CONTINUOUS BELT FILTER PRESS

This patent for industrial invention relates to a continuous tape filter press for treating general products, particularly grapes and dregs of pressed grapes.

The conventional continuous filter presses suffer from a number of disadvantages, among which the most important are as follows:

the operation is slow and the resulting liquid by remaining for long time in contact with air gives rise to a highly prejudicial oxidation process; the slow percolation of the liquid promotes the dispersion of flavours and other volatile products or matters; the majority of conventional continuous filter presses develop a remarkable abrasion on the pressed product with building up of dregs and various deposits; the driving power absorbed for operation is considerable in relation to the processed product; such devices have an undue floor space in relation to the processed product, and a slow and limited adjustment of the pressing.

It is the object of the present invention to provide a novel type of continuous filter press, substantially avoiding the disadvantages found in conventional filter presses, and particularly affording a very rapid pressing so as to reduce to the highest degree the air contact of the liquid and accordingly to avoid oxidation and dispersion of flavours and volatile products or matters; a soft pressing and without any abrasion, thus providing "clean" products; a substantial reduction in absorbed driving power; and then, but not last, an adjustment of pressing in a very rapid manner with the possibility of passing from the depleted product to just dripped product with a full range of intermediate possibilities.

It is another object of the present invention to provide a filter press of minimum floor space when compared at same output with that of conventional filter presses.

These and further objects of the invention will become apparent to those skilled in the art from the following description and appended claims.

A continuous filter press according to the invention is essentially characterized by comprising a pair of continuous tapes or belts arranged in overlapping relationship forward moving in the same direction, a loading hopper overhanging the initial portion of the lower tape or belt of said pair of belts, and means for varying the angle of convergence between said belts of the pair at that portion opposite to said loading hopper, at least the lower belt of the pair having openings for the percolation of the liquid portion and collection of the latter in an underlying vat.

A preferred embodiment of the invention is shown by mere way of unrestrictive example in the figures of the accompanying drawings, in which.

Figure 1:
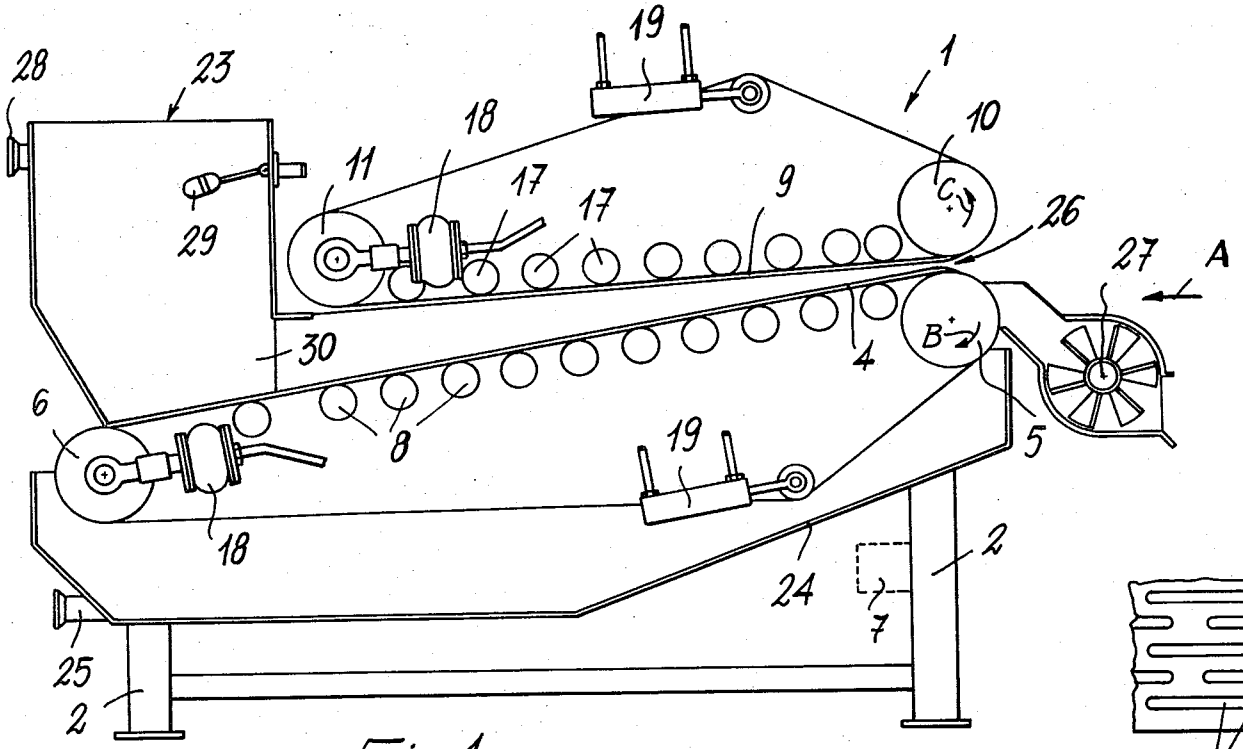
FIG. 1 is a schematic general side view showing the filter press according to the invention.
Figure 3:
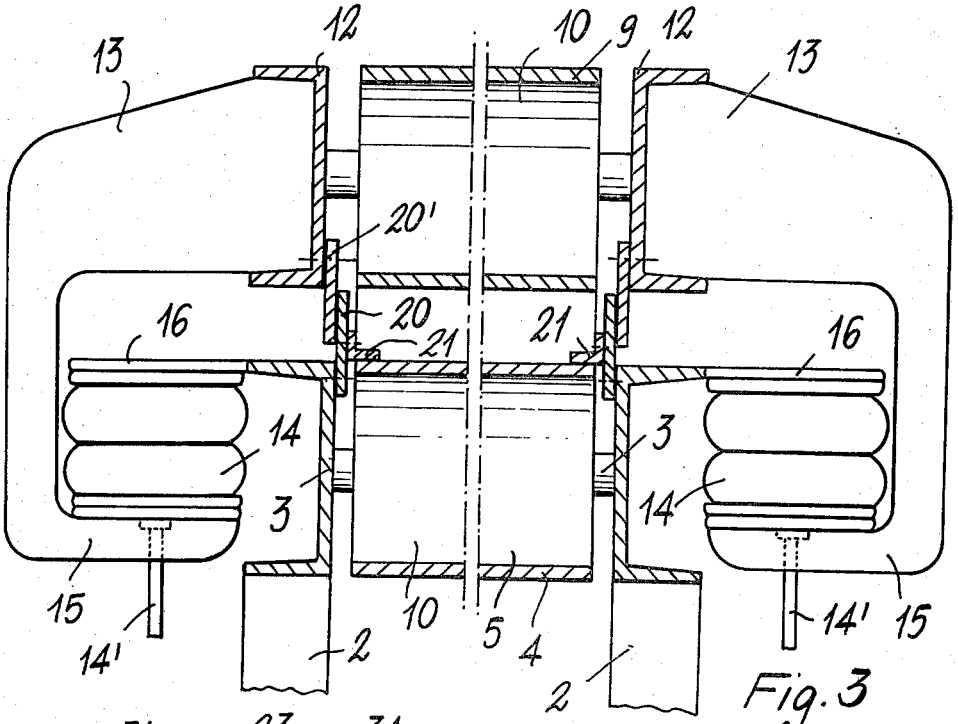
FIG. 3 is an enlarged schematic view of the filter press in the direction of arrow A of FIG. 1, some parts in said figure having been broken away and cut away for a clearer representation of other parts.

Referring now the the above mentioned figures of the accompanying drawings, a filter press designated as a whole at 1 comprises a frame 2 carrying a pair of longitudinal members 3, the latter being parallel and upward inclined from the back of said filter press 1 (see FIGS. 1 and 3).

The longitudinal members 3 form the supporting structure for a lower dripping belt 4 continuously winding about a rear drive roller 5 and a front idle driving roller 6, said rear roller 5 being rotated at adjustable speed in the direction of arrow b by a suitable motor schematically shown at 7. A plurality of small rollers 8, idly and transversely mounted between the longitudinal members 3, carry the lower run of belt 4 between the drive roller 5 and driving roller 6.

At the top of the dripping belt 4 a second supporting structure is provided for an upper dripping belt 9 continuously winding about a rear roller 10 or drive roller, and a front idle driving roller 11, said drive roller 10 being rotated in the direction of arrow c by the same control motor 7 for roller 5 at a same or different speed. Conveniently, a single control motor is used as provided with conventional driving means and a possible geared motor (not shown).

Said second supporting structure for the upper belt 9 essentially comprises (FIG. 3) a pair of parallel longitudinal members 12, pivoted at the front of filter press 1 and about pivot pin of the drive roller 11. Each of the longitudinal members 12 have an extension 13 for support of a pneumatic cushion 14 interposed between a horizontal tab 15 forming part of said extension 13 and a horizontal tab 16, the latter being integral with and laterally projecting from each longitudinal member 3. Suitable conduits 14' are for introducing into and releasing compressed air from said pneumatic cushions 14.

A plurality of small rollers 17, idly mounted transversely of the longitudinal members 12, react against the lower run of belt 9 between the drive roller 10 and the driving roller 11.

The tension in the lower and upper belts 4 and 9, respectively, is controlled by pneumatic tension screws or stretchers 18 acting upon the shafts of the idle driving rollers 6 and 11. Further, said belts 4 and 9 are held at centered relationship to the respective drive rollers 5 and 10, each by a conventional centering device 19.

Small side boards or panels 20 and 20' are provided integral with longitudinal members 3 and 12 (FIG. 3), partly overlapping also with belt 9 at its maximum upward inclination, and said small side boards or panels 20 have a suitable seal 21 pressure cooperating with the lower belt 4.

Figure 2:
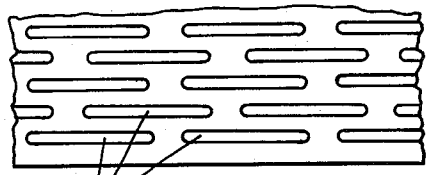
FIG. 2 is a detailed plan view showing a length of a dripping belt.

Said belts 4 and 9, made of fabric-finish rubber or similar products suitable for the treatment of foodstuffs, contemplate a succession of openings 22 (FIG. 2) of substantially elongated shape and transversely arranged in staggered relationship. The width and length of such openings 22 would vary depending on the type of product being treated and consistency (percentage of solid parts to the liquid parts) of the latter. For example, in the case of wine-pressing, the width of these openings 22 is in the range of 0.5–3.5 mm and conveniently the length is 22 mm.

Figure 4:
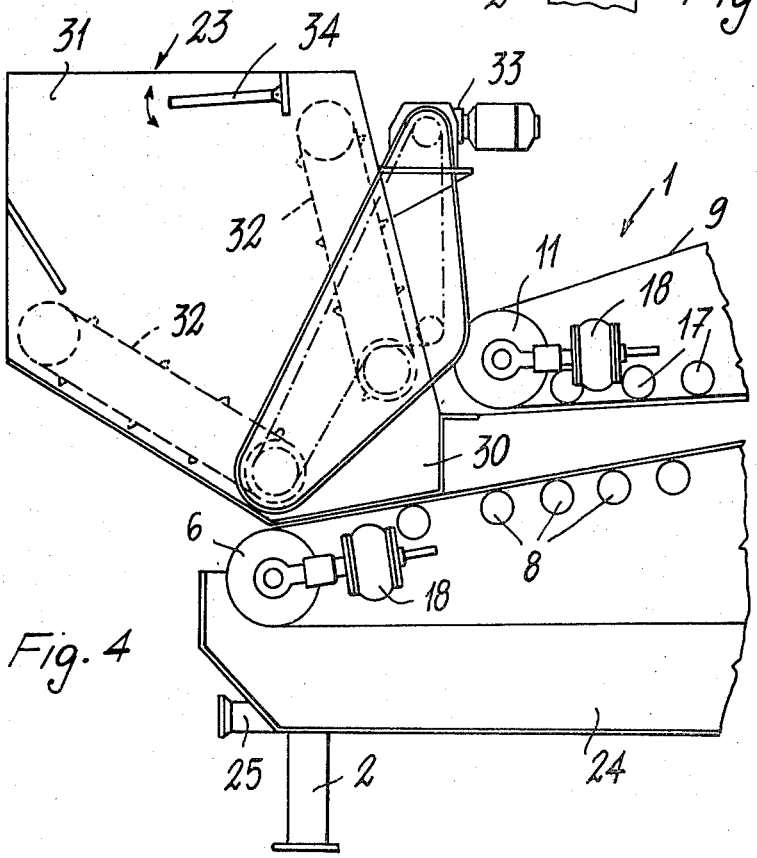
FIG. 4 is a view schematically showing a modified embodiment of the loading hopper.

At the top of and at the initial portion of said lower belt 4, a loading hopper is provided, as generally designated at 23 in FIGS. 1 and 4, and at the bottom of said belt 4 a vat 24 is provided for filtrate collection, which vat is provided with a discharge pipe union 25. At the discharge outlet 26 a suitable blade crumbler 27 is mounted and operated by a respective independent motor (not shown).

Said loading hopper 23 is mounted on filter press 1 in a sealing fashion, which is not shown as conventionally obtainable by any suitable system, and may have the structure shown in FIG. 1 when the product to be treated is already partially pressed or mushy, and the structure shown in FIG. 4 when the product to be treated is still integer.

In the case of hopper 23 shown in FIG. 1, such a hopper is provided with a loading pipe union 28, float 29 and inlet 30 for product feed to belts 4 and 9. In the case of hopper 23 shown in FIG. 4, such a hopper is provided with top loading aperture 31, supply inlet 30 for belts 4 and 9, a pair of conveyor belts 32 operated by a motion variator 33, and a level device 34.

Depending on the type of treatment to which the product is to be subjected, the inclination of the upper belt 9 is adjusted by the introduction into or discharge of air from the pneumatic cushions 14 to vary the pressure exerted by belts 4 and 9 on the product being treated in function of the convergence thereof from the loading hopper 23 to discharge outlet 26. Due to the specific configuration of openings 22, the liquid portion due to the increasing pressure will be percolated through openings 22 and collected in vat 24, while the solid particles are moved to the discharge outlet 26 and therefrom discharge into the crumbler 27.

When treating a product having a higher percentage of liquid portion, the supply control in hopper 23 is carried out by a float 29 driving a conventional pump (not shown) for the product supply in said hopper through the loading pipe union 28, and when treating a product having a higher percentage of solid particles (or even exclusively solid, but crushable), the feed of such a product to belts 4 and 9 will be a forced feed by the forward movement of the conveyor belts 32 and controlled by the level device 34.

It is important to point out that the particular overlapping arrangement for said small side boards or panels 20 and 20' ensure a smooth sealing along the side edges of belts 4 and 9 independently of the angle of inclination of the upper belt 9 relative to the lower belt 4.

Those skilled in the art will appreciate that the foregoing sets forth the essential meaning of the invention, and the teachings thereof may be used for other applications, without departing for this from the scope of the present invention.

What we claim is:

1. A continuous filter press for treating general products, particularly grapes and dregs of pressed grapes, comprising: a vat for the collection of liquid; a pair of moving belts arranged in overlapping relationship, at least the lower belt of the pair of belts having openings for the percolation of the liquid and collection of the liquid in said vat; a loading hopper overhanging a portion of said lower belt; means for varying the angle of convergence between said pair of belts; and side sealing means disposed along the edges of each of said belts, said sealing means being adjustable in height in order to follow the convergence between said pair of belts.

2. A continuous filter press for treating general products, particularly grapes and dregs of pressed grapes, comprising: a vat for the collection of liquid; a pair of moving belts arranged in overlapping relationship, at least the lower belt of the pair of belts having openings for the percolation of the liquid and collection of the liquid in said vat; a loading hopper overhanging a portion of said lower belt; a fixed structure for supporting said lower belt; a movable structure for supporting the upper of said pair of belts; means for pivoting said movable structure; means for varying the angle of convergence between said pair of belts, said varying means cooperating with said fixed and movable structures adjacent the end of said upper belt opposite the pivot location of said pivoting means; side boards or panels disposed along both sides of said structures, each board or panel involving the whole length of the associated belt, the side boards or panels of one structure overlapping the side boards or panels of the other structure to ensure continuous sealing independently of the angle of convergence of said structures; and seals interposed between the side boards or panels of said fixed structure and said lower belt.

3. A continuous filter press according to claims 1 or 2, wherein the means for varying the angle of convergence between the belts of said pair of belts comprise pneumatic cushions interposed between the fixed lower supporting structure and the pivoted upper supporting structure.

4. A continuous filter press for treating general products, particularly grapes and dregs of pressed grapes, comprising: a vat for the collection of liquid; a pair of moving belts arranged in overlapping relationship, at least the lower belt of the pair of belts having openings for the percolation of the liquid and collection of the liquid in said vat; a loading hopper overhanging a portion of said lower belt; a fixed structure for supporting said lower belt; a movable structure for supporting the upper of said pair of belts; means for pivoting said movable structure; means for varying the angle of convergence between said pair of belts, said varying means cooperating with said fixed and movable structures adjacent the end of said upper belt opposite the pivot location of said pivoting means and including pneumatic cushions interposed between said fixed and movable structures.

5. A continuous filter press according to claim 1 or 4, wherein said openings for percolation are of substantially elongated shape disposed in the moving direction of the belt and are transversely disposed in a staggered relationship.

6. A continuous filter press according to claims 1 or 4, wherein said loading hopper includes means for forcibly supplying said products to said pair of belts, whereby said products may include substantially solid products.

7. A continuous filter press according to claim 6, wherein the means for forcibly supplying said pair of belts comprises at least one conveyor belt controlled to advance product to the lower belt of said pair of belts.

* * * * *